United States Patent [19]

Smith et al.

[11] 4,427,253

[45] Jan. 24, 1984

[54] FULLY INSULATED ELECTRICAL CLAMP CONNECTOR WITH INBOARD INSULATING TAB AND SLOT

[75] Inventors: Philip L. Smith; Joseph R. Caprio, both of Madison, Conn.

[73] Assignee: Kupler Corporation, Branford, Conn.

[21] Appl. No.: 326,218

[22] Filed: Dec. 1, 1981

Related U.S. Application Data

[63] Continuation-in-part of Ser. No. 277,991, Jun. 26, 1981.

[51] Int. Cl.[3] ..... H01R 7/04

[52] U.S. Cl. ..... 339/98

[58] Field of Search ..... 339/97 R, 97 P, 98, 339/99 R, 221, 246

[56] References Cited

U.S. PATENT DOCUMENTS

| | | | |
|---|---|---|---|
| 3,199,062 | 8/1965 | Wantz, Jr. | 339/246 |
| 3,388,370 | 6/1968 | Elm | 339/98 |
| 3,452,150 | 6/1969 | Gazzoli | 339/98 |
| 4,211,462 | 7/1980 | Wolfthal | 339/97 R |

FOREIGN PATENT DOCUMENTS

| | | | |
|---|---|---|---|
| 2903960 | 8/1980 | Fed. Rep. of Germany | 339/98 |
| 2428926 | 2/1980 | France | 339/97 R |
| 2436509 | 5/1980 | France | 339/98 |
| 2449979 | 10/1980 | France | 339/98 |

*Primary Examiner*—Joseph H. McGlynn

*Attorney, Agent, or Firm*—Davis, Hoxie, Faithfull & Hapgood

[57] ABSTRACT

Fully insulated clamp connectors for electrically joining insulated wires include molded top and bottom insulating halves bolted together, longitudinal mating grooves in each half for the insulated wires, bridging plates with insulation piercing teeth inserted in slots in each half with the teeth protruding at the grooves, the bridging plates having ramps to lock into the slot sides to prevent removal for safety reasons, and the slots having aligning ridges for the bridging plates. The bridging plates are spaced a distance to maximize the number of strands of insulated wire contacted by the teeth in the connector. Side male-female loosely interfitting parts are on opposite connector halves and dimensioned to allow a degree of rocking of one half with respect to the other to accommodate various sizes of conductors while maintaining full side insulation and long side leakage paths. Cylinder members in one half interfit with the other half to insulate the bolts from the energized connector parts, the cylinder interfit also being dimensioned to allow a degree of rocking of the two halves. An inboard frangible insulating tab is in one or both halves spaced from an end of the half, and an inboard tab slot is in the other or both halves similarly spaced from an end of the half, the tab of one half fitting within a tab slot of the other half to block mating grooves when the two halves are bolted together.

25 Claims, 10 Drawing Figures

FULLY INSULATED ELECTRICAL CLAMP CONNECTOR WITH INBOARD INSULATING TAB AND SLOT

This application is a continuation-in-part of application Ser. No. 277,991 filed June 26, 1981 by the same applicants, for "Fully Insulated Electrical Clamp Connector".

BACKGROUND OF THE INVENTION

This invention relates to electrical clamp connectors for insulated conductors. Such connectors often have opposite halves with mating grooves for the conductors, and bridging plates extending between the grooves and having insulation piercing teeth at the grooves to electrically connect two or more insulated conductors within the connector. In such known connectors, attempts are made to fully insulate the inside energized parts from the outside environment, but such connectors are also required to operate with various sizes and various relative sizes of conductors. Under certain such conductor conditions, the opposite connector halves need to rotate a number of degrees, i.e., ten to fifteen degrees, with respect to each other upon assembly, and this can cause interference fits or broken parts at the connector sides and also can cause the connector halves to partially or completely separate at one or both sides to expose the inner energized parts to the environment and to an operator. Such exposure obviously presents extreme danger to an operator's safety. Such prior art connectors for this reason also may not be used with higher voltage conductors because of short leakage paths to the outside and the risk of arcing. In short, such connectors are not fully insulated, are not easy to operate with various conductor sizes and relative sizes, and have maximum voltage limitations.

In addition, known connectors may not provide adequate insulation between the end of an enclosed conductor and the outside end of a connector in those instances where a conductor terminates within the connector (i.e., a splice or tap-off use of the connector). Even an insulating tab or cover at the connector end may, in certain applications, provide insufficient insulation and an insufficiently long leakage path to the outside environment from a conductor end abutting the tab. Such insulating end tabs or covers also may, unless of large dimension, partially expose a conductor end upon rotation of the connector halves to accommodate various sizes and relative sizes of conductors.

Still further, such prior art connectors either involve costly and time consuming methods of inserting and attaching the insulation piercing teeth to the connector halves, or else do not adequately attach such teeth so that upon disassembly of the connectors and removal of one or more conductors, the insulation piercing teeth also become removed from the connector halves with the conductors. The electrically conductive teeth are then exposed to direct operator contact and create a very serious risk of electrical shock or electrocution to the operator.

In addition, prior art connectors may function imperfectly with stranded conductors, in that the insulation piercing teeth only contact a very few rather than most of the inner conductive strands of the insulated conductors. As a result, the few contacted strands and teeth heat up excessively.

Furthermore, certain forms of prior art connectors do not provide a sufficient watertight seal where a conductor passes into or out of the connector.

SUMMARY OF INVENTION

In the present invention, a fully insulated electrical clamp connector is provided for electrically joining insulated conductors. The connector has molded top and bottom insulating halves bolted together, and includes means to fully insulate the bolts from energized parts within the connector. Each connector half has longitudinal grooves to enclose the conductors upon assembly of the connector halves. Bridging plates with insulation piercing teeth are inserted in slots perpendicular to the grooves, with the teeth protruding at the grooves.

The bridging plates may be of the same width or narrower than the slots, the plates also having one or more ramps that lock the teethed plates in the slots upon insertion so that subsequent removal of pierced conductors from the connector does not also cause the bridging plates to be removed from the slots to thereby present a dangerous electrical shock hazard. Where the bridging plates are narrower than the slots, ridges in the slots provide aligning means for the bridging plates in relation to the conductors. The bridging plates can also be spaced a distance from one another within the connector, taking into consideration the number of strands and lay of stranded conductors, to maximize the number of strands contacted by the teeth in the connector.

At the sides of the connector loosely interfitting male-female members on opposite connector halves are provided, with considerable depth, in order to allow the connector halves on assembly to pivot up to ten to fifteen degrees or so with respect to each other to accommodate various conductor sizes and relative sizes. The loose interfit of the male-female members, being longitudinal legs and channels reversed in position at opposite sides of the connector, allows the aforementioned degree of pivoting without creating interference fits, broken parts and/or opening of the sides of the connector halves for exposure of energized parts. A fully insulated structure not presently known to the art is thereby achieved even under conditions of varying conductor sizes and relative sizes. The considerable depth of interfitting of the longitudinal side legs and channels also creates long leakage paths at the sides of the connector, so that considerably higher voltages can be handled by the connector.

With the above construction, adequate insulation and a long leakage path are still required as to conductor ends terminating within the connector. A groove-blocking inboard insulating tab is provided in one or both connector halves spaced from an end of the connector half. The tab may be positioned adjacent a bridging member slot between the bridging member slot and said end, or may be positioned further inboard the connector between bridging member slots. Likewise, a mating inboard tab slot is provided within a groove in the other or both connector halves spaced from an end of the connector half, and may be similarly positioned. When the connector halves are bolted together, the inboard tab of one half fits to a considerable depth within the inboard slot of the other half to block mating grooves, even with the degree of pivoting referred to above. When a conductor end terminates within the connector, it will abut a tab, and the leakage path from the conductor end to the outside connector end must then transverse the tab down into, around the bottom of, and back out the slot, and then along the mating grooves to the outer connector end. A long end leakage path thus is created for the handling of considerably higher voltages by the connector, and the conductor end is fully insulated. Each tab may be integrally attached to a side male leg member and a groove, and each tab slot extends into and from a side female channel member; this configuration insures electrical protection of the conductor end. Where the conductor end does not terminate within the connector, the tab may easily be broken off to allow passage of the conductor through the connector. Each tab and mating tab slot may extend across either one or both sets of mating grooves when the connector halves are bolted together, depending upon the connector application. It may be advantageous to provide one tab and one slot in each connector half, such that when the connector halves are bolted together, the mating grooves for one conductor are blocked inboard at one connector end and the mating grooves for the other conductor are blocked inboard at the other connector end. In this manner, the connector may be used as a splice without breaking either tab, or as a tap-off by breaking one of the tabs. In addition, the inboard tab may be a member that fits within mating tab slots in each of the connector halves, the tab either being separable or glued to one of the connector halves. Still further, a separable tab may be a resilient member with a central conductor opening, to provide a watertight seal about conductors entering and leaving the connector.

Advantages and objects of the present invention therefore include the provision of a fully insulated connector under conditions of various conductor sizes and relative sizes; a connector that is easy to manufacture and safe to the operator assembling and disassembling the connector; and a connector that can handle higher voltages by virtue of long side and end leakage paths created by its design. A further advantage of the inboard tab and inboard slot configuration is a saving in material. These advantages and objects and others are shown in the drawings and description of embodiments hereinafter.

DESCRIPTION OF EMBODIMENTS

Figure 1:
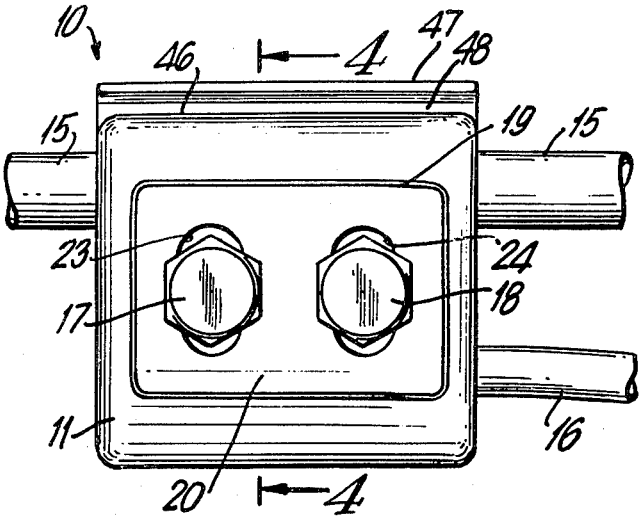
FIG. 1 is an overhead view of the fully insulated electrical clamp connector of the present invention.
Figure 2:
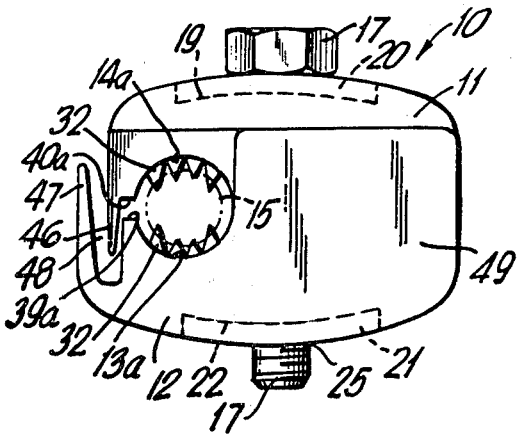
FIG. 2 is a left end view of the connector shown in FIG. 1.
Figure 4:
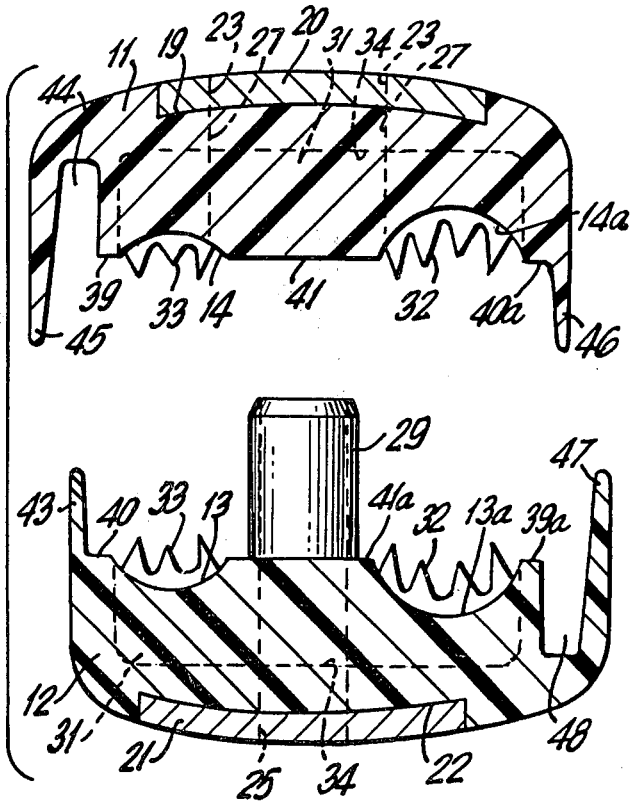
FIG. 4 is a view along section lines 4—4 of FIGS. 1 and 3, with the two halves of the connector disassembled but in aligned position with each other.

A fully insulated electrical clamp connector 10 comprises an upper half portion 11 and a lower half portion 12, as shown in FIGS. 2 and 4, generally molded of durable insulating material resistant to exposure to the weather. Such material may be a glass-filled nylon, for example. Lower half and upper half portions 12 and 11 have grooves 13, 13*a* and 14, 14*a* therein, as shown in FIG. 4, extending longitudinally of the connector 10. Insulated electrical conductors 15 and 16 shown in FIG. 1 and 2 are enclosed by the corresponding grooves 13, 14 (as to conductor 16) and 13*a*, 14*a* (as to conductor 15) when the two connector halves 11 and 12 are assembled together by threaded bolts 17 and 18. In the example shown in FIG. 1, conductor 15 is a main insulated electrical conductor passing through connector 10, and conductor 16 is a tap-off insulated electrical conductor terminating in connector 10.

Inserted in a recess 19 in the top connector half 11 is a metal pressure bearing plate 20, and a similar metal pressure bearing plate 21 is likewise inserted in a corresponding recess 22 in bottom connector half 12. Metal plates 20, 21 have openings for bolts 17, 18 to pass through, the openings 23, 24 in top metal plate 20 being elliptical as shown in FIG. 1. The openings 25, 26 in bottom metal plate 22 are circular and threaded, so that bolts 17, 18 may be screwed into holes 25, 26 to enclose and tighten the connector halves 11, 12 around insulated conductors 15 and 16. Top connector half 11 also has elliptical openings 27, 28 extending therethrough and corresponding in size to elliptical openings 23, 24 in metal plate 20, the purpose of these several elliptical openings to be described hereinafter. Bottom connector half 12 has cylinders 29, 30 integral therewith and extending upwardly as shown in FIG. 4, the cylinders 29,30 extending into the elliptical openings 27, 28, respectively, when the connector 10 is assembled. In that condition, the bolts 17, 18 respectively pass through openings 23, 24 in metal plate 20, openings 27, 28 in top connector half 11, cylinders 29, 30 in bottom connector half 12, and are then threaded through openings 25, 26 in metal plate 21.

Figure 6:
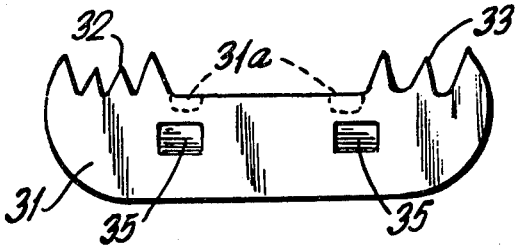
FIG. 6 is a side view of wire bridging and insulation piercing means of the connector of the present invention.

In order to electrically connect together main conductor 15 and tap-off conductor 16 assembled within connector 10, contact bridging plates 31 are provided as shown in FIG. 6, comprised of electrically conductive metal. Bridging plates 31 have piercing teeth portions 32, 33 at opposite ends for piercing the insulation of conductors 16, 15 respectively, the teeth being directed radially inward of the insulated conductors. Contact bridging plates 31 are set into narrow slots 34 molded in top connector half 11 and bottom connector half 12, the embodiment shown having three such slots 34 and three such contact bridging plates 31 in each of top connector half 11 and bottom connector half 12. Slots 34 are positioned perpendicular to parallel grooves 13, 13*a*, and 14, 14*a*, so that teethed bridging plates 31 are positioned perpendicular to conductors 14, 15 upon assembly. When connector halves 11 and 12 are assembled around insulated connectors 15 and 16 by the tightening of bolts 17, 18 to a predetermined torque, the teeth portions 32, 33 pierce the insulation of conductors 15, 16 respectively and the teeth come in direct contact with the electrical conductor material underlying the insulation. Since bridging plates 31 are conductive, insulated main conductor 15 thereby comes into electrical connection with insulated tap-off conductor 16.

Figure 3:
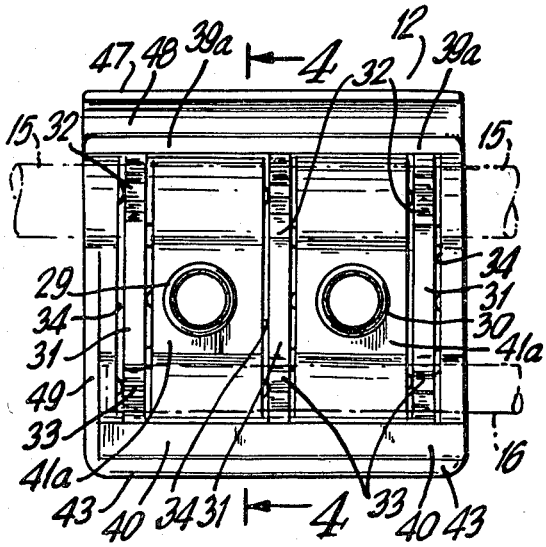
FIG. 3 is an overhead view of the bottom half of the connector of FIG. 1.

The contact bridging plates 31 in connector bottom half 12 are positioned parallel to one another, and spaced longitudinally from each other in the direction of the insulated conductors 15, 16. The same is true of plates 31 in connector top half 11, with each plate 31 in top half 11 directly overlying a plate 31 in bottom half 12. Insulated conductors 15, 16 often have inner helically stranded current carrying members, and in that event, plates 31 are spaced longitudinally such that the teeth 32, 33 on one plate contact conductor strands missed by an adjacent plate 31. For example, in a common 12 strand conductor 15 with a six inch lay (i.e., the strands return to the same identical geometric position every six inches), plates 31 are longitudinally spaced one inch from each other along the connector 10. The teeth 33 on bottom left-side plate 31 in FIG. 3 (bottom connector half 12) will then contact strands 1,2,3,4 of the 12 strand conductor 15, with the directly overlying teeth 33 of top plate 31 (top connector half 11) contacting strands 7,8,9,10; the teeth 33 on bottom middle plate 31 will then contact strands 3,4,5,6 with the overlying teeth 33 of top plate 31 contacting strands 9,10,11,12; and the teeth 33 on bottom right-side plate 31 will then contact strands 5,6,7,8 with the overlying teeth 33 of top plate 31 contacting strands 11,12,1,2. By spacing plates 31 in relation to the stranding and lay, therefore, a maximization is achieved of the number of conductor strands contacted by the teeth in a connector 10. The current flow, from one stranded conductor through each bridging plate to the other stranded conductor, thereby occurs through a maximum number of strands to avoid the excessive heating that would occur if only a few strands were contacted by the teeth within a connector.

Figure 7:
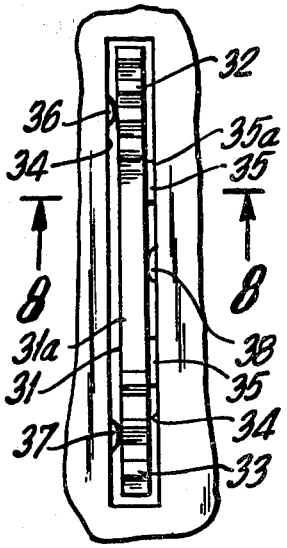
FIG. 7 is an enlarged overhead view of the wire bridging and insulation piercing means of FIG. 6 located in a channel of one of the halves of the connector.
Figure 8:
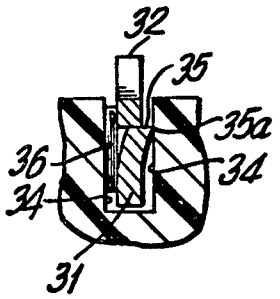
FIG. 8 is a view along section 8—8 of FIG. 7.

It is essential that teethed contact bridging plates 31, once inserted in slots 34 in top and bottom halves 11, 12 of the connector 10, not be removable even though an operable connector 10 is disassembled at a later date (i.e., to disconnect a tap-off conductor, make a new tap-off electrical connection, carry out maintenance, remove the connector altogether, etc.). If the connector 10 is disassembled and conductors 15 and/or 16 are lifted out of the connector, bridging plates 31 with their teeth in the insulation of the conductors must not lift out of the connector along with the conductors; otherwise, a possibility of physical injury or electrocution exists for the operator making touch contact with bridging plate 31, since plate 31 is electrically connected to main conductor 15. To assure that bridging plates 31 remain in slots 34, once initially inserted at manufacture, reference is made to FIGS. 6, 7, and 8 (FIG. 7 being an enlarged view of one of the plate-slot combinations of FIG. 3). FIG. 6 illustrates a teethed contact bridging plate 31 having two side ramps 35 punched therein which act as barbs or fishhooks when plate 31 is inserted into slot 34, by digging into the side of slot 34 and thereby preventing withdrawal of plate 31 from slot 34 (see FIG. 8). One, or more than two, side ramps 35 may also be utilized. As shown, each plate 31 is narrower than its slot 34, and each slot 34 has three inwardly directed ridges 36, 37, 38. These ridges, two (36, 37) positioned on one side of the slot 34 and the other (38) positioned in between on the other side of the slot 34, allow relatively easy insertion of plate 31 into slot 34 because of limited friction, and the three ridges so positioned also serve to position plate 31 perpendicular to a conductor in the connector. Alternatively, the ridges 36, 37, 38 may be eliminated, and each plate 31 may have the same width dimension as its slot 34. The two ramps 35 shown are positioned respectively adjacent the teeth 32 and 33, since that is where the maximum pulling on plate 31 occurs when a pierced conductor 15 or 16 is being removed from connector 10. As plate 31 is being inserted into slot 34, the slot sidewall adjacent ramps 35 resiliently gives as the ramps enter the slot. Once the plate 31 (and thus ramps 35) is fully inserted, the ramp pointed edges **35*a* dig into the side of slot 34 and thus plate 34 cannot be removed from the slot. A connector 10 is thereby obtained which is safe to the operator upon dissassembly and removal of one or more conductors. In addition, the described structure allows fast and inexpensive means to insert and lock the plates 31 in slots 34**, as opposed to more expensive and slower means of insertion and locking such as by molding or glueing or pinning.

As an alternative to forming the ramps 35 in bridging plates 31 before insertion of the bridging plates, flat-sided bridging plates may be inserted into slots 34 followed by a forceful downward blow onto surface **31*a* of each plate between the teeth, thereby forcing metal of the plate sideways (as shown in dotted lines in FIG. 6) into the adjacent side walls of slot 34 to lock the bridging plate 31 into the slot 34**.

Connector 10 will be used with conductors 15, 16 of different sizes and different relative sizes, FIG. 4 illustrating mating grooves 13 and 14 as smaller in size than mating grooves **13*a* and 14*a***, though the grooves may all be the same size. It is important that the assembled connector be fully insulated as to its energized parts at all times and under all such conductor size conditions by means here to be described.

Figure 5:
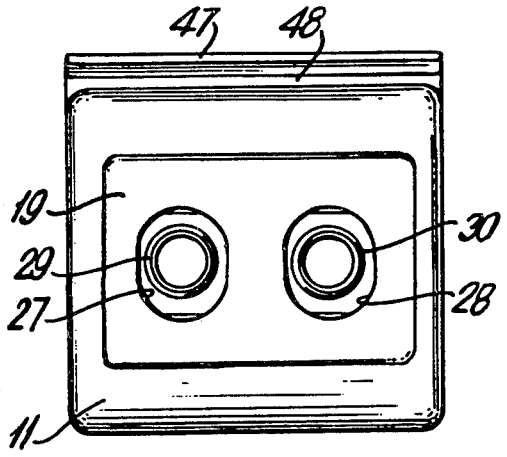
FIG. 5 is an overhead view of the connector corresponding to FIG. 1, but with a top metal plate removed.

FIG. 4 shows connector halves 11 and 12 disassembled but in aligned position for assembly. Adjacent groove 14 is ledge 39 and adjacent groove **13*a* is ledge 39*a*. Adjacent groove 13 is ledge 40, and adjacent groove 14*a* is ledge 40*a*. Ledges 39 and 40*a* are in the same line as center ledge 41, and ledges 40 and 39*a* are in the same line as center ledge 41*a*. All of the said ledges extend longitudinally along the length of the connector 10. Upon assembly of connector 10, ledge 39 may contact ledge 40, or ledge 40*a* may contact ledge 39*a*, depending upon the sizes and relative sizes of conductors 15 and 16 being clamped. For certain conductor diameter sizes, the top connector half 11 may have to pivot upon assembly of the order of ten to fifteen degrees about a longitudinal axis 42 (see FIG. 4) with respect to bottom connector half 12 in order to accommodate different sized conductors. Means are provided to allow the described pivoting, including elliptical openings 23, 24 and 27, 28 in metal plate 20 and top half 11 being of a larger size than interfitting cylinders 29, 30 on assembly (See FIGS. 4 and 5) to allow a certain amount of rock of cylinders 29, 30 (and thus bottom half 12) within the larger mating elliptical openings 23, 24 and 27, 28**.

Further and importantly, when connector 10 is fully assembled, upstanding leg 43 of bottom connector half 12 (referring to FIGS. 2 and 4) fits within upstanding side channel 44 of top connector half 11, the channel 44 being defined by ledge 39 and depending leg 45 of top connector half 11. Legs 43 and 45, and channel 44, extend longitudinally all along the length of connector 10. Directly corresponding structure is provided by legs 46 and 47, and channel 48, at the other side of the connector 10. The vertical dimension of leg 43 from ledge 40 is less than the vertical dimension of channel 44 from ledge 39, and the horizontal width of leg 43 is less than the horizontal width of channel 44. In this manner, leg 43 is permitted the aforementioned degree of pivoting freedom within channel 44 when the two connector halves 11 and 12 are pivoted with respect to each other about axis 42, upon assembly, to accommodate variously sized conductors 15 and 16. This particular connector structure avoids interference fits and/or breakage at the connector side parts upon the pivoting, even in the instance of ledges 39 and 40 being in contact with each other. The exact same dimensioning is provided with regard to leg 46 depending from ledge 40*a* and channel 48 depending from ledge 39*a*, for the same reason. Therefore, on both sides of connector 10, a loose male-female interfitting of parts is provided to fully insulate the connector on its sides even under various conditions of pivoting caused by various sizes of conductors. It will be noted that, upon assembly of the connector, leg 45 extends a considerable distance down the side of bottom connector half 12 and leg 47 extends a considerable distance up the side of top connector half 11, each connector half having a male member extending longitudinally along one of its sides and a female member extending longitudinally along the other of its sides. The particular structure described prevents side exposure of either conductor 15 or 16 even under the described degree of pivoting.

A further advantage of the interfitting structure described directly above is that long side leakage paths are provided on both sides of the connector so that it can handle higher voltage. In FIGS. 2 and 4 (upon assembly), the side electrical leakage path is defined from a conductor between teeth 33, for example, to flow between ledges 39 and 40, then upwardly into channel 44 along leg 43, around the top of leg 43, and then downwardly between legs 43 and 45 to the bottom of leg 45. The other side of the connector has a correspondingly long leakage path by virtue of its corresponding structure. The structure of the present invention is therefore not only fully insulated, but also able to handle high voltages on the conductors by virtue of the long side leakage paths provided from the pierced conductors to the environment outside the connector. If desired, even longer leakage paths may be created by providing a further downwardly extending leg from a portion of ledge 39 and a mating, loosely interfitting, channel in ledge 40; corresponding structure could of course be provided in regard to ledges 39*a* and 40*a*.

Figure 9:
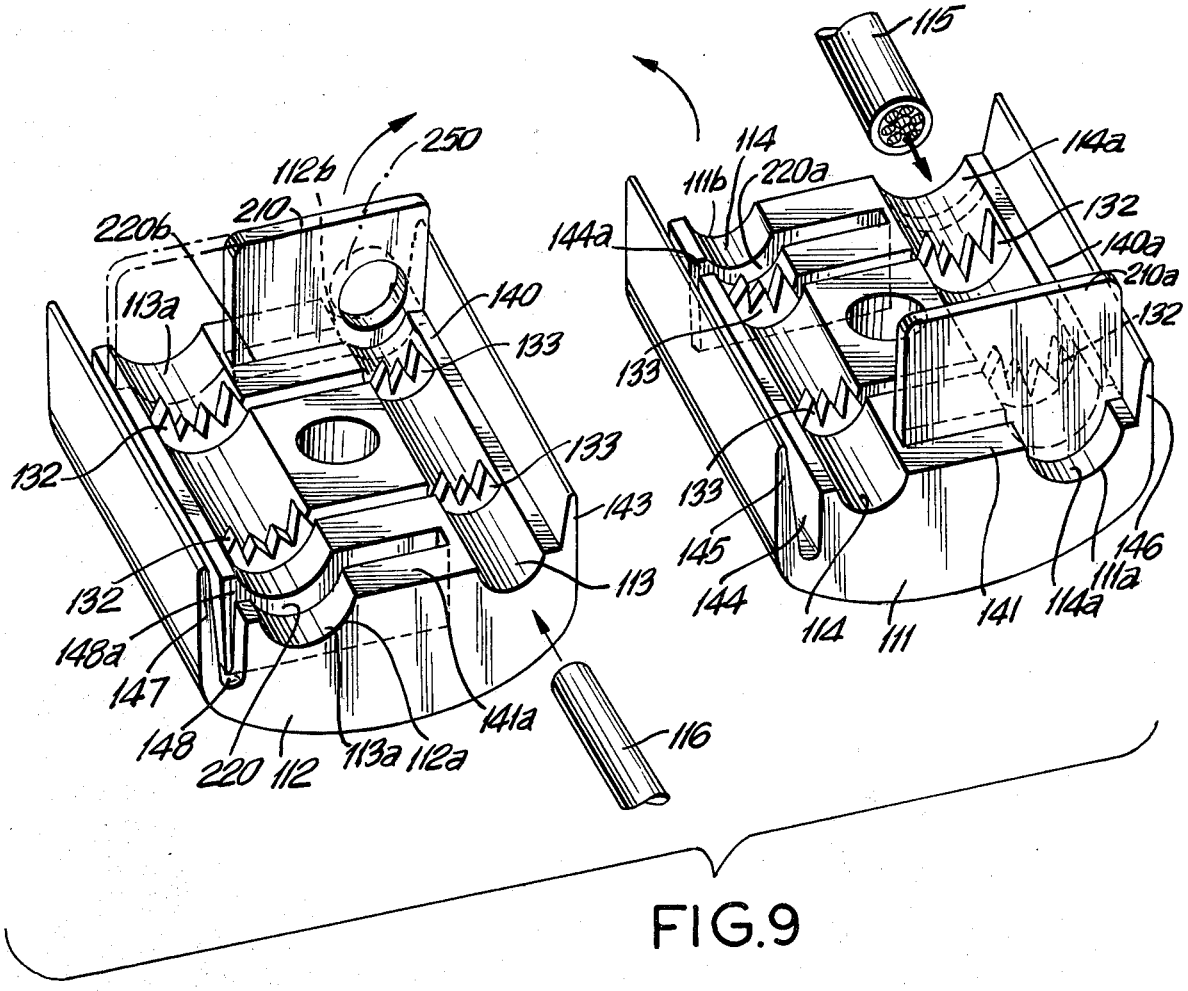
FIG. 9 is a view of the two disconnected connector halves, illustrating the inboard insulating tabs and inboard tab slots; and, FIG. 10 is a partial end view of the connector halves of FIG. 9 bolted together.
Figure 10:
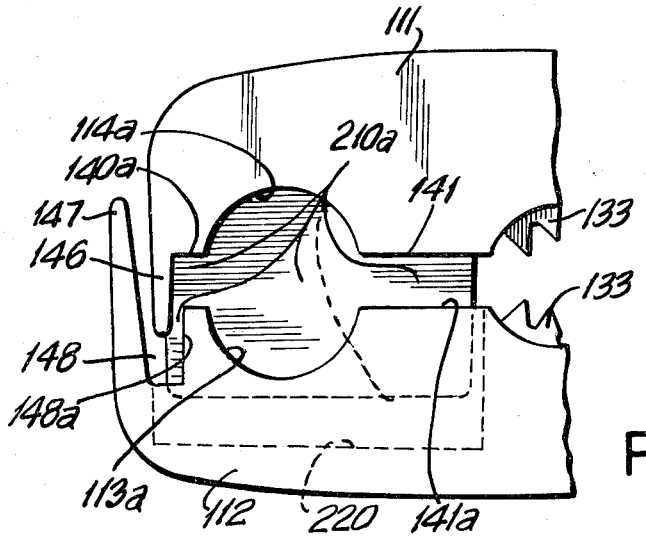

Referring now to FIGS. 9 and 10, parts shown therein corresponding to the parts and description of FIGS. 1–8 have their numbers increased by 100 (i.e., connector half 11 of FIG. 1 is designated connector half 111 in FIGS. 9 and 10). These corresponding parts of FIGS. 9 and 10 are identical in structure and function to those of FIGS. 1–8, and further description thereof is believed unnecessary except as set forth below. FIG. 9 illustrates two disconnected connector halves 111 and 112, which may be connected together in the directions of the curved arrows at the top of FIG. 9 to obtain the connected device of FIG. 10 (generally corresponding to the view of FIG. 2). FIG. 9 for the sake of simplicity illustrates a device having one connecting bolt rather than two, and two pairs of teethed bridging plates rather than three, it being appreciated that the number of bolts and bridging plates may be varied in the present invention depending upon the size and electrical power rating of the conductors upon which the clamp connector is to used.

FIG. 9 further includes insulating tab 210 comprised of durable insulating material, the tab being integrally attached, as by molding or glueing, to side male member 143, ledge 140, groove 113 and center ledge 141*a*. Tab 210 is spaced inboard of end 112*b* of connector half 112, between end 112*b* and adjacent teeth portion 133. Tab 210 accordingly extends transversely from male member 143 beyond groove 113 and also extends a distance above male member 143. An identical inboard tab 210*a* likewise is contained and molded into connector half 111, between end 111*a* and teeth portion 132, this tab being molded into side male member 146, ledge 140*a*, groove 114*a* and center ledge 141.

Also contained in connector half 112 is tab slot 220, spaced inboard of end 112*a* between end 112*a* and adjacent teeth portion 132. Tab slot 220 extends into the bottom of groove 113*a*, beyond groove 113*a* into center ledge 141*a*, and generally transversely from female channel 148; it will further be noted that the tab slot breaks through the side and bottom walls of channel 148 at 148*a* and thus into the channel. An identical tab slot 220*a* likewise is contained in connector half 111, positioned inboard of end 111*b* and between end 111*b* and adjacent teeth portion 133. The identical tab slot 220*a* extends into the bottom of groove 114, into center ledge 141, and generally transversely from female channel 144; in similar fashion, tab slot 220*a* breaks through the side and bottom walls of channel 144 at 144*a* and thus into the channel.

When connector halves 111 and 112 are connected together, insulating tab 210*a* fits within tab slot 220 and insulating tab 210 fits within tab slot 220*a*. Conductor 115 is enclosed in mating grooves 113*a* and 114*a*, and conductor 116 is enclosed within mating grooves 113 and 114. If the connector is to be used as a splice of conductors 115 and 116 (i.e., both conductors are cut), both tabs 210 and 210*a* will remain in place with conductor 116 abutting tab 210 and conductor 115 abutting tab 210*a*. If the connector is to be used as a tap-off (i.e., only one conductor is cut and the other conductor extends as a run through the connector), one of the tabs will be broken off to permit passage of the conductor through the connector. The tabs 210 and 210*a* are thin frangible members and may be snapped off with pliers to break at the lines where each tab joins the remainder of its connector half. As a tap-off, the cut conductor will abut the tab remaining in place.

As shown in FIG. 10, inboard tab 210*a* when the connector halves are bolted together extends from integral male member 146 through the side wall of channel 148 at 148*a* and into slot 220 which extends on into center ledge 141*a*. Tab 210*a* can extend to a considerable depth into, but not to the bottom of, slot 220, so that the aforesaid described pivoting of connector halves 111 and 112, to accommodate various sizes of conductors, will not result in a portion of tab 210*a* coming out of slot 220 to defeat the insulating purpose of the inboard tab and slot. In FIG. 10 the connector is enclosing a quite large conductor 115 in mating grooves 113*a*, 114*a*, and the bottom of tab 210*a* thus is further above the bottom of slot 220 than would be the case if a smaller conductor were being enclosed. Slot 220 also is wider than tab 210*a* in a lengthwise direction so as not to cause any interfering fit between tab 210*a* and slot 220.

With tab 210*a* in slot 220 as shown in FIG. 10, the cut end of conductor 115 abuts tab 210*a* and accordingly is spaced from end 111*a* (and 112*a*) of the connector.

Further, and importantly, the leakage path from the end of conductor 115 to the end 111*a* (and 112*a*) is down into slot 220 along one side of tab 210*a* to the bottom of the tab 210*a*, back up the other side of tab 210*a* out of the slot 220, and then along grooves 113*a* and 114*a* to the exterior end of the connector. Since tab 210*a* is integral with side male member 146, the bottom of groove 114*a* and center ledge 141, leakage cannot occur between tab 210*a* and those parts. In this manner, a long leakage path is provided from the conductor end to the exterior end of the connector, and this in conjunction with the long side leakage paths created by the male-female parts 146, 148 provides a fully insulated electrical clamp connector with long leakage paths at all points. FIG. 2 on the other hand illustrates an end insulating tab 49 connected to bottom connector half 12 to cover grooves 13,14. Tab 49 is not positioned inboard the connector end in an inboard slot, and the leakage path of FIG. 2 from an abutting end of conductor 16 is accordingly only up the inner side of tab 49 to the exterior end of the connector. It may therefore be seen that the inboard tab and slot configuration of FIGS. 9 and 10 provides a much longer leakage path and thus a considerably enhanced insulating ability that is advantageous in certain higher voltage applications. The inboard tab also may be of smaller dimension than an end insulating tab, resulting in a saving of material. In certain applications of particular-sized conductors enclosed in the connector of FIGS. 9 and 10, it is possible that leakage may traverse the tab 210*a* between the end of conductor 115 and the bottom of male member 146, and then pass along channel 148 for example, but such a leakage path to the environment outside the connector end will still be considerably longer than that provided by end tab configurations.

It will be apparent from the above description and FIGS. 9, 10 that inboard tab 210 interrelates with slot 220*a* and the surrounding structure in the identical fashion to provide the identical advantages.

While the above description references a structure wherein each inboard tab and its corresponding tab slot are positioned between an end of the connector and the bridging members, it should be appreciated that in certain applications the tab and corresponding tab slot may be positioned still further inboard between spaced bridging members. One such application, for example, comprises a connector with two bolts and four pairs of electrical bridging members, each connector half having one bridging member between one connector end and a first bolt, two inner spaced bridging members both positioned between the two bolts, and a further bridging member between the other bolt and the other connector end. In this connector application, for example, the inboard tab and corresponding tab slot may be positioned between the two inner bridging members, in order for one conductor to run through the connector and two other conductors to enter in the same mating grooves (i.e., corresponding to 113,114) from opposite ends of the connector and respectively terminate against opposite sides of the inboard tab. Such an application provides two tap-offs from one connector.

As an alternative structure, tab 210 may be a separable tab member that, when the connector halves are bolted together, slides and extends into tab slot 220*a* and also slides and extends into a further and similar aligned underlying slot 220*b* (shown in dotted line in FIG. 9) in groove 113 and center ledge 141*a* of connector half 112. If desired, tab 210 initially may be inserted into tab slot 220*b*, and glued to male member 143 (as well as slot 220*b* if desired) in order to seal off leakage current between tab 210 and male member 143. Tab 210*a* of course could then take the same configuration with a similar slot in groove 114*a* and center ledge 141 of connector half 111 aligned with slot 220 in connector half 112.

As a further alternative structure, slots 220 and/or 220*a* may continue all the way across grooves 113 and 114*a* respectively (as in the dotted line continuation of slot 220*a* across groove 114*a* in FIG. 9), and tabs 210 and/or 210*a* may continue all the way across grooves 113*a* and 114 respectively (as in the dotted line continuation of tab 210 across groove 113*a* in FIG. 9); those portions of tabs 210 and 210*a* then being broken off as desired depending upon the particular connector application. In this further embodiment, the continued or extended tab across both grooves may be integrally attached to its connector half, or again may be a separable tab that, when the connector halves are bolted together, slides and extends into aligned tab slots in each half portion that continue across both grooves. A continued tab across both grooves also may be glued to a male member as referred to above. This configuration where a tab extends across two grooves is useful, for example, where the connector is used as a splice and both conductors enter the connector from the same end of the connector.

In a still further structure, a separable tab such as 210 may take the form of a resilient member, such as rubber, which fits into slots 220*a* and 220*b* (upon bolting together of the connector halves) and which has a central opening 250. In this configuration, useful in certain instances where it is desired to pass a conductor 116 completely through the connector without termination therein, the conductor 116 is forced through opening 250 to create a watertight seal about the conductor and tab 210 otherwise seals off the inside of the connector from water entry from connector end 112*b*, 111*b*. In this instance of a conductor running through the connector, the same resilient tab structure adjacent the other ends of mating grooves 113, 114, would likewise allow passage of conductor 116 through a central opening and otherwise seal off the inside of the connector. Alternatively, one such resilient tab with a central opening 250 may be positioned near one end of the connector to allow passage of a conductor into the connector, and a further tab with no central opening, as previously described, may be positioned further into the connector to terminate the conductor within the connector.

It should be understood that various modifications of the present invention may be made without departing from the spirit and scope of the invention as hereinafter claimed, and that the clamp connector of the present invention may be useful with bare wire rather than insulated conductors.

What is claimed is:

1. An electrical clamp connector, comprising: first and second half portions molded of electrically insulating material and means to bolt said half portions together; each half portion having at least two lengthwise grooves therein, the grooves mating and serving to enclose conductors upon bolting of the two half portions together; electrical bridging members having piercing teethed portions; bridging member slots in the half portions generally transverse to the grooves for insertion of the bridging members, the teeth protruding from the grooves upon said insertion; means permitting pivoting of the half portions with respect to each other upon assembly to accommodate various conductor sizes while maintaining a fully insulated connector along both its sides; a tab slot for an insulating tab in at least the first half portion, the tab slot being positioned inboard and spaced from an end of the first half portion; an insulating tab in at least the second half portion, said tab being positioned inboard and spaced from an end of the second half portion; the insulating tab blocking the passage of at least one groove through the second half portion; and, said insulating tab fitting within said tab slot upon the two half portions of the connector being bolted together to also block the passage of at least one mating groove through the first half portion and thereby fully insulate a conductor end from the exterior end of the connector.

2. The invention of claim 1, wherein the means permitting pivoting of the half portions while maintaining a fully insulated connector along both its sides includes loosely interfitting male-female members forming parts of the connector half portions and extending longitudinally along both sides of the connector upon the two half portions being bolted together.

3. The invention of claim 2, wherein one side of each half portion has a male leg member and the other side of each half portion has a female channel member.

4. The invention of claims 2 or 3, wherein the insulating tab is integrally attached to a male member and to and extending from the bottom of at least one groove of the second half portion, the tab also extending traversely from the male member and beyond the said groove; the tab slot extends transversely from a female member, into a side wall thereof, into the bottom of at least one groove of the first half portion, and beyond the said groove of the half portion; and, said insulating tab has a sufficient height to extend into the tab slot below the bottom of said groove of the first half portion when the two half portions of the connector are bolted together.

5. The invention of claim 4, wherein the insulating tab extends above its connected male member.

6. The invention of claim 4, wherein the insulating tab has a height dimension to extend to a considerable depth within but not to the bottom of a tab slot when the connector half portions are bolted together about conductors.

7. The invention of claim 4, wherein said insulating tab is a thin frangible member.

8. The invention of claim 4, wherein each connector half portion has a tab slot in one groove and an insulating tab extending from a second groove, the tab of each half portion fitting within the respective slot of the other half portion upon the two half portions being bolted together.

9. The invention of claim 4, wherein the leakage path from the end of a conductor abutting an insulating tab to the exterior of the connector at its end, when the two half portions of the connector are bolted together to enclose the conductor, extends along the tab down into, around the bottom of, and back out of the tab slot and thereafter along a groove to the exterior end of the connector.

10. The invention of claim 4, wherein the tab slot is positioned adjacent to a bridging member slot between said bridging member slot and said end of the first half portion, and said tab is positioned adjacent to a bridging member slot between said bridging member slot and said end of the second half portion.

11. The invention of claim 4, wherein the tab slot and tab are positioned between bridging member slots in their respective half portions.

12. The invention of claim 4, wherein the tab slot and tab each extend across at least two lengthwise grooves in their respective half portions.

13. An electrical clamp connector, comprising: first and second half portions molded of electrically insulating material and means to bolt said half portions together; each half portion having at least two lengthwise grooves therein, the grooves mating and serving to enclose conductors upon bolting of the two half portions together; electrical bridging members having piercing teethed portions; bridging member slots in the half portions generally transverse to the grooves for insertion of the bridging members, the teeth protruding from the grooves upon said insertion; means permitting pivoting of the half portions with respect to each other upon assembly to accommodate various conductor sizes while maintaining a fully insulated connector along both its sides; a tab slot for an insulating tab in each half portion, each tab slot being positioned inboard and spaced from an end of the half portion and the tab slots in each half portion being aligned when the half portions are bolted together; and, an insulating tab for insertion into the tab slot of each half portion and extending from said tab slots to completely block the passage of mating grooves when the two half portions of the connector are bolted together, thereby fully insulating a conductor end from the exterior end of the connector.

14. The invention of claim 13, wherein the insulating tab is glued to one of the half portions.

15. The invention of claim 13, wherein the means permitting pivoting of the half portions while maintaining a fully insulated connector along both its sides includes loosely interfitting male-female members forming parts of the connector half portions and extending longitudinally along both sides of the connector upon the two half portions being bolted together.

16. The invention of claim 15, wherein one side of each half portion has a male leg member and the other side of each half portion has a female channel member.

17. The invention of claims 15 or 16, wherein the tab slot in the first half portion extends transversely from a female member, into a side wall thereof, into the bottom of at least one groove of the first half portion, and beyond the said groove of the first half portion; the tab slot in the second half portion extends transversely from a male member, into the bottom of at least one groove of the second half portion, and beyond the said groove of the second half portion; and the insulating tab has a sufficient height to extend into both the tab slots below the bottoms of mating grooves when the two half portions of the connector are bolted together.

18. The invention of claim 17, wherein the leakage path from the end of a conductor abutting an insulating tab to the exterior of the connector at its end, when the two half portions of the connector are bolted together to enclose the conductor, extends along the tab down into, around the bottom of, and back out of a tab slot and thereafter along a groove to the exterior end of the connector.

19. The invention of claim 17, wherein each tab slot is positioned adjacent to a bridging member slot between said bridging member slot and an end of its respective half portion.

20. The invention of claim 17, wherein each tab slot is positioned between bridging member slots in its respective half portion.

21. The invention of claim 17, wherein each said tab slot extends across at least two lengthwise grooves in its respective half portion, and the tab extends across at least two lengthwise grooves when inserted into mating tab slots.

22. The invention of claim 17, wherein said insulating tab is a thin frangible member.

23. The invention of claim 17, wherein the insulating tab is glued to a male member of one of the half portions.

24. The invention of claim 17, wherein the insulating tab has a height dimension to extend to a considerable depth within each tab slot but not to the bottom of both tab slots when the connector half portions are bolted together about conductors.

25. An electrical clamp connector, comprising: first and second half portions molded of electrically insulating material and means to bolt said half portions together; each half portion having at least two lengthwise grooves therein, the grooves mating and serving to enclose conductors upon bolting of the two half portions together; electrical bridging members having piercing teethed portions; bridging member slots in the half portions generally transverse to the grooves for insertion of the bridging members, the teeth protruding from the grooves upon said insertion; means permitting pivoting of the half portions with respect to each other upon assembly to accommodate various conductor sizes while maintaining a fully insulated connector along both its sides; a tab slot for an insulating tab in each half portion, each tab slot being positioned inboard and spaced from an end of the half portion and the tab slots in each half portion being aligned when the half portions are bolted together; and, an insulating tab for insertion into the tab slot of each half portion and extending from said tab slots across mating grooves when the two half portions of the connector are bolted together, the tab being comprised of a resilient means with an opening therein for passage therethrough of a conductor.

* * * * *